United States Patent [19]

Swanson

[11] Patent Number: 4,671,513

[45] Date of Patent: Jun. 9, 1987

[54] GOLF CLUB IRONS

[76] Inventor: Arthur P. Swanson, 1454 Estate La., Glenview, Ill. 60025

[21] Appl. No.: 882,307

[22] Filed: Jul. 7, 1986

[51] Int. Cl.[4] ..... A63B 53/04

[52] U.S. Cl. ..... 273/172; 273/167 A

[58] Field of Search ..... 273/167 A, 172, 174, 273/169, 170, 171, 173, 167 F, 167 R; D21/217, 218, 219, 220, 214, 215, 216

[56] References Cited

U.S. PATENT DOCUMENTS

| | | | |
|---|---|---|---|
| 1,436,579 | 11/1922 | Dayton | 273/172 X |
| 2,041,676 | 5/1936 | Gallagher | 273/174 |
| 3,088,736 | 5/1963 | Mospan | 273/80 |
| 3,199,873 | 8/1965 | Surratt | 273/163 |
| 3,961,796 | 6/1976 | Thompson | 273/167 A |
| 3,992,013 | 11/1976 | Golden | 273/172 X |
| 4,345,763 | 8/1982 | Swanson | 273/164 |
| 4,498,673 | 2/1985 | Swanson | 273/172 |

FOREIGN PATENT DOCUMENTS

| | | | |
|---|---|---|---|
| 5902 | of 1894 | United Kingdom | 273/174 |

*Primary Examiner*—George J. Marlo

[57] ABSTRACT

The blade heads of golf club irons are provided with protuberances or knobs on the bottom sole faces thereof to minimize "fat" shots, reduce the size of divots, and to accommodate tilting of the club head on the turf laterally and in front to rear directions without spoiling the shot. The protuberance or knob on the sole is positioned rearwardly from the striking face of the head, extends lengthwise about ⅓ the length of the sole and merges upwardly to the rear face of the head. The front face of the knob is curved or arcuate in a top to bottom plane and also in a longitudinal plane. The rear face of the knob is curved upwardly to smoothly merge into and mate with the rear face of the head. The maximum depth of the knob is on the axis of the center of balance or "sweet spot" of the head. While the longitudinal length of the knob remains substantially the same for all irons, the fore-to-aft width and the depth of the knob will increase with the increase in the loft or angular inclination of the striking face of the head and the fore-to-aft width of the sole. Since the knob accommodates lateral tilting of the club head, a single standard shaft inclination and length will accommodate golfers of all heights.

11 Claims, 8 Drawing Figures

1/16"-1/8"
1"-1 1/4"
5/16"
5/8"
1/3 L
L

GOLF CLUB IRONS

FIELD OF THE INVENTION

This invention relates to the art of golf club irons and particularly relates to the heads of golf club irons which have localized central protuberances or knobs on the soles thereof to accommodate rocking of the club on the turf and avoiding "fat" shots.

BACKGROUND OF THE INVENTION

Golf club irons have sole portions designed to lie flat on the turf when addressing the ball. These soles will increase in fore-to-aft width or thickness as the angle of inclination of the striking face increases. If the sole does not lie flat on the turf when addressing and striking the ball, the club head will dig into the ground creating a "fat" shot and producing a very deep and wide divot.

PRIOR ART

Projections on the soles of so-called "utility" golf club woods have been proposed to lessen turf drag. My prior U.S. Pat. No. 4,498,673, issued Feb. 12, 1985, discloses and claims such a club, but the fragmental spherical projection on the sole of this wood club cannot be accommodated on the sole of an iron club.

Round bottom and keel bottom irons so distort the striking face as to destroy the accuracy of the iron without having much effect on the width of the divot.

My prior U.S. Pat. No. 4,345,763, issued Aug. 24, 1982, discloses and claims golf club irons with substantially rectangular heads which have increased striking face areas and top and bottom parallel edges for ease in sighting alignment of the club when addressing the ball.

It would be an improvement in this art to provide a narrow elongated ear, protuberance or knob on a localized central portion of the sole of golf club irons to avoid "fat" shots and wide divots and to accommodate standard shaft angles and lengths for all heights of golfers.

It would be a specific improvement in this art to provide a localized elongated and rounded projection or knob on the sole of a golf club iron such as disclosed and claimed in my aforesaid U.S. Pat. No. 4,345,763.

It would be another improvement in this art to provide a lofted blade type golf iron with a longitudinally elongated round bottom knob on the sole with its deepest central zone or apex on the "sweet spot" axis which is spaced closer to the heel than to the toe of the blade.

SUMMARY OF THIS INVENTION

According to this invention, golf club irons are provided with heads having localized narrow elongated rounded protuberances, ears, or knobs on the longitudinal central portions of the soles thereof just rearwardly from the bottom edge of the striking face extending lengthwise on the central portion of the sole closer to the heel than to the toe and merged into the rear face of the head. The longitudinal central portion of the elongated knob is on the axis of the "sweet spot" which is the balance center of the striking face. This center of balance is the point where the blade head will not rotate when the club is suspended and the striking face is impacted by tapping it at different points along its length. The length of the knob is preferably about $\frac{1}{3}$ the longitudinal length of the sole and is in the order of 1 to $1\frac{1}{4}$ inches. The front face of the knob is bowed rearwardly from the longitudinal center to the ends. The bottom face of the knob increases in depth from the front face and, in a seven iron, will preferably reach a depth of about 5/16". In the seven iron, the fore-to-aft width or thickness of the knob is preferably about $\frac{5}{8}$". The depth and fore-to-aft dimensions of the knob will increase in direct proportion to the loft or angle of inclination of the striking face of the iron and the thickness or fore-to-aft width of the sole. Thus, the 1–6 irons will have knobs of lesser depth and thickness dimensions than the 7 iron while the knobs of the 8, 9, pitching wedge and sand irons will have greater dimensions. The longitudinal length of the knob, however, remains substantially constant for all irons.

The projection or knob does not in any way affect the striking face area or shape since its front bottom edge is preferably from about 1/16 to $\frac{1}{8}$" rearwardly from the bottom front edge of the head.

The knob adds weight under the sole of the blade confined at a small central zone lowering the center of gravity of the blade and providing extra inertia power at impact.

The maximum width of a divot cut by the club will be about the same as the length of the knob. The club head can be rocked to a tilted angle and the divot will not be affected. The knob, of course, minimizes drag through the turf.

It is then an object of this invention to provide a lofted blade golf club iron with a localized rounded knob projection on the central portion of the sole of the club blade to avoid "fat" shots and minimize turf drag and divot width.

Another object of this invention is to provide a blade type golf club iron with a sole having a localized elongated heavy protuberance along the central portion rearwardly from the front bottom edge of the striking face and curved in fore-to-aft and longitudinal directions to a maximum depth under about the center of the width of the sole on the axis of the "sweet spot" and then curving upwardly to merge into the back face of the head.

A specific object of this invention is to provide a localized knob on the bottom of the longitudinal central portion of the head of a golf club iron rearwardly from the bottom front edge and merged into the rear face of the head.

Another specific object of this invention is to improve the golf irons of the type disclosed and claimed in my aforesaid U.S. Pat. No. 4,345,763 by adding a localized knob projection to the sole extending about $\frac{1}{3}$ the length of the sole at the central portion thereof.

Other and further objects of this invention will be apparent to those skilled in the art from the following detailed description of the annexed drawings showing a preferred embodiment of the invention.

ON THE DRAWINGS

FIG. 1 is front elevational view of the golf club iron according to this invention.

FIG. 2 is a bottom plan view of the golf club iron of FIG. 1.

FIG. 3 is a toe end elevational view of the golf club iron of FIGS. 1 and 2.

FIG. 4 is a cross sectional view along the line IV—IV of FIG. 1.

FIG. 5 is a fragmentary cross sectional view along the line V—V of FIG. 3.

FIG. 6 is a toe end elevational view similar to FIG. 3 but showing a less lofted club.

FIG. 7 is a diagrammatic front elevational view of the club of FIG. 1 illustrating the manner in which the club head can be laterally rocked or tilted on the turf.

FIG. 8 is a view similar to FIG. 7 but illustrating the manner in which the club can be rocked or tilted in a fore-to-aft direction on the turf.

BRIEF DESCRIPTION OF THE DRAWINGS

The golf club iron 10 of FIG. 1 has a generally rectangular metal blade head 11 with an upwardly and rearwardly inclined hosel 12 receiving the lower end of a shaft 13 with a handgrip 14 on the upper end thereof. The head 11 is metal and is of the blade type having a general configuration of the golf club irons disclosed and claimed in my aforesaid U.S. Pat. No. 4,345,763. As shown, the club head 11 has an upright toe 15 with rounded top and bottom ends, a heel 16 merged forwardly into the bottom of the hosel 12, an inclined front striking face 17 with a bottom front edge 18 extending from the toe to the heel and a top edge 19 parallel with the bottom edge 18.

A bottom sole 20 extends rearwardly from the edge 18 to an upright back face 21 with an inturned shoulder 21*a* below the top edge 19 providing a reduced thickness for the top edge 19. The inclined striking face 17 has a plurality of spaced parallel grooves 22 extending horizontally thereacross.

Figures 1, 2, 3, 4, 5, 6, 7, 8:
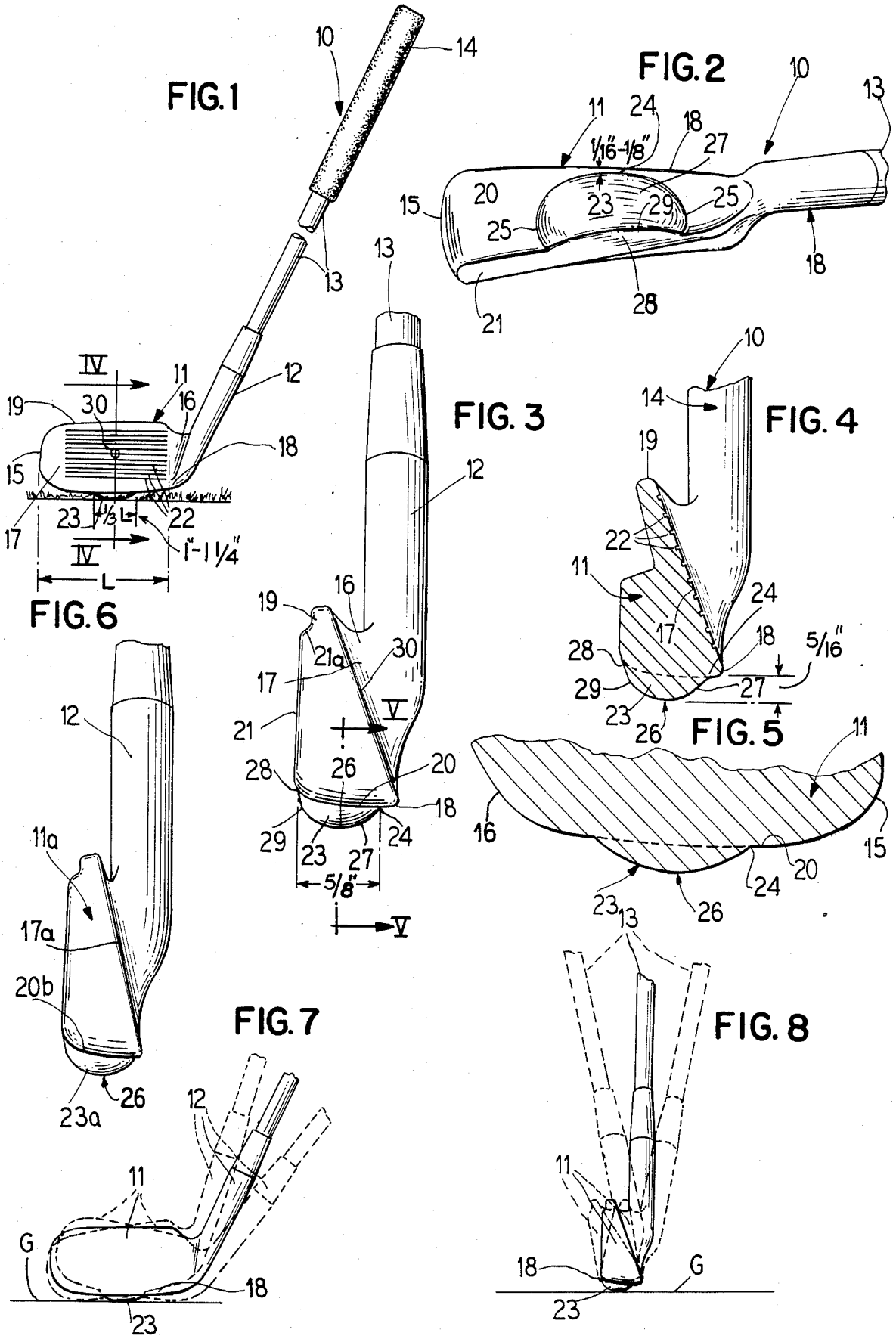

According to this invention, a rounded knob 23 is formed on the longitudinal central portion of the sole 20 just rearwardly from the front bottom edge 18. This knob preferably has a longitudinal length of about $1\frac{1}{4}$ inches which is about $\frac{1}{3}$ the length L of the blade head 11 as shown in FIG. 1.

As shown in FIG. 2, the knob 23 has a convex curved front face 24 coming closest to the edge 18 at its longitudinal center and then curving rearwardly to rounded ends 25. The margin between the front edge 18 and the front face of the knob 23 thus increases from the preferred illustrated narrow 1/16 to $\frac{1}{8}''$ margin at the center line to wider margins at the ends 25.

As shown in FIG. 3, the knob 23 increases in depth from the rounded front edge 24 to a maximum depth, illustrated at 26, which is on the axis of the "sweet spot" or balance center of the blade which is somewhat closer to the heel 16 than to the toe 15. A rearwardly bevelled or rounded front surface 27 is thus provided from the edge 24 to the maximum depth apex 26. Then the knob converges upwardly in a rounded or arcuate path to merge into the bottom of the back face 21 at 28 thereby providing a rounded back face 29.

The knob 23 therefore has a rounded front longitudinal face, a rounded front-to-rear face diverging to a bottom apex and then a rounded back face merging into the back face of the club head. This provides arcuate surfaces on which the club head can be tilted in all directions especially as illustrated in FIGS. 7 and 8.

The knob 23 is solid and heavy, preferably being an integral metal portion of the metal blade head 11, and adding weight under the sole with its deepest apex on the axis of the "sweet spot" or longitudinal center balance zone generally illustrated at 30 in FIG. 1 where the center line IV—IV also represents the transverse axis which when tapped when the club is freely suspended will not cause the club head to rotate.

As shown, for example in FIG. 7, the knob 23 when resting on the turf or ground G, permits the club head 11 to be rocked laterally through a wide angle without digging the bottom edge 18 of the club head into the ground. Then, as illustrated in FIG. 8, the club head 11 can be rocked substantially in a fore-to-aft direction without grounding the sole 18.

The spacing of the knob 23 behind the front edge 18 and with its deepest apex on the longitudinal balance center of the blade head where the "sweet spot" is located will give added concentrated weight lowering the center of gravity of the blade thereby providing additional inertia to increase the power stroke of the club. The longitudinal length of the knob will then extend about $\frac{1}{2}$ inch each way from this central apex curving both longitudinally and transversely upward to merge into the sole 20. Further, the knob will not interfere with or in any way change the striking face 17. Since the knob only has a reduced length of about $\frac{1}{3}$ the longitudinal length of the club head, any divot cut by the knob will be quite narrow.

The free rocking or tilting of the club illustrated in FIGS. 7 and 8 makes possible the marketing of a single standard club shaft length and angle of inclination to fit golfers of different heights.

The club of FIGS. 1–5 is a number 7 iron and the illustrated depth and width of the knob 23 is proportioned for a club of this loft and sole width. However, as illustrated in FIG. 6, a club head 11*a* of lower loft, such as a number 2 iron, has a knob 23*a* of lesser depth and width to accommodate the narrower sole 20*a* and less inclined face 17*a*. The contour of this knob 23*a*, however, is substantially the same as the knob 23 and it has about the same length as the knob 23. The variations in depth and fore-to-aft dimensions vary only to suit the variations in the soles of clubs of different loft.

From the above descriptions it should be understood to those skilled in this art that this invention provides a golf club iron with a single knob on the sole thereof to accommodate tilting or rocking of the club head in all directions for reducing turf drag, divot widths, and minimizing "fat" shots.

I claim:

1. A golf club iron having an elongated blade head with a toe, a heel, an upwardly and rearwardly inclined hosel on the heel, a front striking face, a bottom front edge extending from the toe to the heel, a top edge extending from the toe to the heel, a back face, a bottom sole between the bottom front edge and the back face, and a rounded knob elongated longitudinally of the club head and located on the central portion of the sole rearwardly from the bottom front edge and having a rounded front face bowed rearwardly from its longitudinal center to its ends, a rounded bottom increasing in depth from a position adjacent said front face to an apex forwardly from said back face, and a back face merged into the back face of the head.

2. The golf club iron of claim 1 wherein the rounded knob has a longitudinal length of about $\frac{1}{3}$ the length of the head.

3. The golf club iron of claim 1 wherein the blade head has a sweet spot center of balance transverse axis face closer to the heel than to the toe which when tapped along its length will not cause the club head to rotate when the club is freely suspended, and the maximum depth of said rounded knob is on said axis.

4. The golf club iron of claim 1 wherein the knob is heavy and adds weight under the longitudinal central area of the sole to provide additional inertia to increase the power stroke of the club.

5. The golf club iron of claim 1 wherein the rounded knob is about 1 to $1\frac{1}{4}$ inches long, about 5/16" deep and about $\frac{5}{8}$" wide.

6. In a lofted golf club iron having an elongated blade with a toe, a heel, a bottom sole, a front striking face, a bottom front edge and a longitudinal center of balance axis where the blade head will not rotate when the club is freely suspended and tapped along said axis, said axis being closer to the heel than the toe, the improvement of a localized longitudinally elongated depending knob on the sole rearwardly of the front edge of substantially less length than the blade head and with a maximum depth on said axis.

7. In the golf club iron of claim 6 the further improvement of the length of said knob being about $\frac{1}{3}$ the length of the blade head.

8. In the golf club iron of claim 6 the further improvement of an arcuate fore-to-aft face on the knob.

9. In the golf club iron of claim 6 the further improvement of said knob having a convex curved front face coming closest to the front edge at the center of balance axis of the blade.

10. In the golf club iron of claim 6 the further improvement of said knob having a longitudinal length of about 1 to $1\frac{1}{4}$".

11. In a blade type golf iron with a lofted striking face, a bottom sole, a front bottom edge between the striking face and sole and an upright back face, the improvement of a depending localized integral rounded protuberance on the longitudinal central portion of the sole spaced behind the front bottom edge and merged into the back face, said protuberance being longitudinally elongated, arcuate along its length and width, and having a depth increasing with the fore-to-aft width of the sole and the loft of the striking face, said protuberance accommodating rocking of the blade on the turf longitudinally and forwardly and rearwardly without grounding the sole.

* * * * *